US011020749B2

(12) United States Patent
Zhou et al.

(10) Patent No.: US 11,020,749 B2
(45) Date of Patent: Jun. 1, 2021

(54) SERVO CONTROL DEVICE AND METHOD FOR DISC GAP IN DISC POWDER GRINDING SYSTEM

(71) Applicant: Northeastern University, Shenyang (CN)

(72) Inventors: Ping Zhou, Shenyang (CN); Mingjie Li, Shenyang (CN); Hong Wang, Shenyang (CN); Tianyou Chai, Shenyang (CN)

(73) Assignee: NORTHEASTERN UNIVERSITY, Shenyang (CN)

( * ) Notice: Subject to any disclaimer, the term of this patent is extended or adjusted under 35 U.S.C. 154(b) by 210 days.

(21) Appl. No.: 16/318,594

(22) PCT Filed: Dec. 13, 2018

(86) PCT No.: PCT/CN2018/120760
§ 371 (c)(1),
(2) Date: Jan. 17, 2019

(87) PCT Pub. No.: WO2020/062604
PCT Pub. Date: Apr. 2, 2020

(65) Prior Publication Data

US 2020/0101468 A1 Apr. 2, 2020

(30) Foreign Application Priority Data

Sep. 30, 2018 (CN) ..... 201811157900.1

(51) Int. Cl.
*B02C 7/14* (2006.01)
*B02C 7/16* (2006.01)
*D21D 1/30* (2006.01)

(52) U.S. Cl.
CPC . *B02C 7/14* (2013.01); *B02C 7/16* (2013.01)

(58) Field of Classification Search
CPC . B02C 25/00; B02C 7/14; D21D 1/30; D21D 1/303; D21D 1/306
See application file for complete search history.

(56) References Cited

U.S. PATENT DOCUMENTS 3,737,109 A * 6/1973 Johansson ..... F16C 35/061 241/37
4,073,442 A 2/1978 Virving
(Continued)

FOREIGN PATENT DOCUMENTS

CN 201744377 U 2/2011
CN 206881905 U * 1/2018
(Continued)

OTHER PUBLICATIONS

English translate (CN206881905U ), retrieved date Aug. 7, 2020.*
International Search Report based on Chinese Application No. PCT/CN2018/120760 dated Apr. 8, 2019.

*Primary Examiner* — Adam J Eiseman
*Assistant Examiner* — Mohammed S. Alawadi
(74) *Attorney, Agent, or Firm* — Muncy, Geissler, Olds & Lowe, P.C.

(57) ABSTRACT

Provided is a disc gap servo control device and method for a powder grinding system, which includes a disc powder grinding machine, a rotating speed regulating device of a rotating disc, the disc gap servo control device and a control cabinet. The method includes the following steps of: (1) inputting a control information; (2) an industrial computer obtaining a current disc gap and displaying the disc gap on a touch screen; (3) the disc gap servo control device adjusting the disc gap; (4) the current disc gap reaches a target disc gap; and (5) a frequency converter controlling a motor rotating speed, so that the actual rotating disc rotating speed can reach a target rotating speed of the rotating disc. The operation parameters of the rotating disc are observed by the
(Continued)

industrial computer in real time, and finally a high-precision servo control of the disc gap can be realized.

1 Claim, 2 Drawing Sheets

(56) References Cited

U.S. PATENT DOCUMENTS

| | | | | | |
|---|---|---|---|---|---|
| 4,454,991 | A * | 6/1984 | Brenholdt | D21D 1/30 | 241/259.2 |
| 4,820,980 | A * | 4/1989 | Dodson-Edgars | B02C 7/14 | 241/37 |
| 5,042,726 | A * | 8/1991 | Reinhall | D21B 1/12 | 162/23 |
| 5,067,660 | A * | 11/1991 | Reinhall | B02C 7/14 | 241/37 |
| 5,927,628 | A * | 7/1999 | Lima | B02C 7/14 | 241/259.1 |
| 2006/0231649 | A1* | 10/2006 | Demler | D21D 1/002 | 241/21 |
| 2017/0050188 | A1* | 2/2017 | Pischtschan | B02C 4/42 | |
| 2019/0262837 | A1* | 8/2019 | Lefas | B02C 7/08 | |

FOREIGN PATENT DOCUMENTS

| | | | |
|---|---|---|---|
| CN | 107442262 | A | 12/2018 |
| CN | 206881905 | U | 1/2019 |

* cited by examiner

SERVO CONTROL DEVICE AND METHOD FOR DISC GAP IN DISC POWDER GRINDING SYSTEM

BACKGROUND OF THE INVENTION

1. Field of the Invention

The present invention belongs to the technical field of control for a disc gap in a disc powder grinding system, and particularly relates to a servo control device and method for a disc gap in a disc powder grinding system.

2. The Prior Arts

In the food processing industry, the disc gap is an important parameter of a disc powder grinding machine mainly because the disc gap not only affects the flour particle size of a powder grinding system, but also directly affects the production efficiency and the life of the disc powder grinding machine. For example, in the food processing industry, the flour particle size is often used as one of the evaluation indexes of the flour quality grade. Through control of the flour particle size, the quality change of flour can be better controlled, and the raw materials that meet the requirements can be provided for the subsequent food processing procedures, so that the efficiency and the control quality of the entire system can be improved. Moreover, in the papermaking industry, the fiber length is one of the important indexes to determine the quality of paper pulp, and the fiber length is not only related to the quality of the paper pulp and energy consumption in the pulping process, but also directly affects the quality of paper products in the subsequent paper making process. However, in the actual industrial production process, the disc gap, as an important process parameter, appears to be very important for whether the product quality can meet the actual production requirements, and the high-precision control of the disc gap becomes an important factor affecting the final product quality, production efficiency, power consumption and the like.

At present, the disc gap of most disc powder grinding machines is controlled through hydraulic adjustment and mechanical adjustment. For example, in the food processing industry, a pulping machine adopts a hydraulic system to drive a rotating disc to move horizontally, so that setting of the disc gap is indirectly realized through a horizontal displacement. The mechanical adjustment mainly refers to shaking a worm and a worm gear through a hand wheel, through the trapezoidal screw drive in the center of the worm gear, the rotating disc finally achieves the purpose of adjusting the disc gap, and the gap size is usually measured by a pointer and a dial at the hand wheel. However, the above two methods only indirectly drive the rotating disc of the disc powder grinding machine to move horizontally, so that the precision of the two methods in the control of the disc gap is limited. The mechanical adjustment method requires manual adjustment, which causes a time lag in the gap control.

In order to solve the problem of on-line control of the current disc powder grinding system, an electric servo position positioning system is adopted to drive the rotating disc to move, so that the control precision of the displacement of the rotating disc can be effectively improved. A position sensor is adopted for feeding back the actual displacement data of the rotating disc, and the given displacement of the rotating disc is corrected in real time, so that the real-time, the rapidity and the like of the displacement control of the rotating disc can be guaranteed. Moreover, a static disc is used as a zero reference position, and the displacement of the rotating disc is finally converted into the disc gap to realize the on-line high-precision control of the disc gap. Therefore, realization of the disc gap control of the disc powder grinding system not only can effectively improve the product quality and reduce the energy consumption, but also can ensure the safe and efficient operation of the production equipment.

SUMMARY OF THE INVENTION

In order to solve the above technical problems, the present invention provides a disc gap servo control device for a disc powder grinding system, which comprises a disc powder grinding machine, a rotating speed regulating device of a rotating disc, the disc gap servo control device and a control cabinet.

The control cabinet comprises a touch screen, an industrial computer and a programmable controller.

The touch screen is connected with the industrial computer, and a control information is input to the industrial computer through the touch screen.

The industrial computer is connected with the programmable controller, and a working state of the disc gap servo control device is controlled by the programmable controller; the industrial computer is connected with the rotating speed regulating device of the rotating disc and the disc gap servo control device and receives a working state information of the disc gap servo control device, and the working state information is displayed on the touch screen.

The programmable controller is connected with and controls the rotating speed regulating device of the rotating disc and the disc gap servo control device.

The programmable controller controls the rotating speed regulating device of the rotating disc and the disc gap servo control device according to a control command of the industrial computer.

A feed opening and a discharge opening are disposed in a grinding chamber of the disc powder grinding machine, and the rotating disc and a static disc are arranged in the grinding chamber, wherein a center of the rotating disc is fixedly connected with a rotating shaft; the static disc is fixed inside the grinding chamber.

The rotating shaft is connected with the rotating speed regulating device of the rotating disc.

The rotating speed regulating device of the rotating disc comprises a driving motor; the rotating speed regulating device of the rotating disc forms a transmission connection with the rotating shaft through a conveyor belt, and drives the rotating disc through the rotating shaft to provide power for the disc powder grinding machine.

The disc gap servo control device comprises an AC servo motor, a transmission device and a position sensor.

The transmission device comprises a decelerator and a mechanical linkage, wherein the mechanical linkage is connected with the rotating shaft.

One end of the decelerator is connected to the AC servo motor, and the other end of the decelerator is connected to the mechanical linkage; the decelerator is used for converting the power of the AC servo motor into the power that drives the mechanical linkage to move horizontally, so as to control a spacing between the rotating disc and the static disc.

The position sensor is mounted on the mechanical linkage of the disc powder grinding machine, a position signal of the rotating disc is collected in real time with a position movement of the mechanical linkage, and the position signal is fed back to the control cabinet.

The disc powder grinding machine is a double-disc powder grinding machine.

Diameters of the static disc and the rotating disc, a specification of the driving motor, and a rotating speed of the rotating disc are determined according to the actual production efficiency and material hardness.

The diameters of the static disc and the rotating disc are 500 mm.

The driving motor is a three-phase asynchronous motor, of which the power is 3 kW and the rotating speed is 0-3000 r/min.

The power of the AC servo motor is 1 kW.

The rotating speed regulating device of the rotating disc further comprises a frequency converter; and the frequency converter is separately connected with the driving motor and the programmable controller of the control cabinet, wherein the programmable controller controls the frequency converter according to a control command of the industrial computer, so as to control a rotating speed of the driving motor.

A disc gap servo control method for a disc powder grinding system, which adopts the disc gap servo control device for the disc powder grinding system, comprises the following steps of:

Step 1, inputting a control information to the industrial computer through the touch screen, wherein the control information comprises a target rotating disc rotating speed and a target disc gap;

Step 2, transmitting a position information to the industrial computer through the position sensor, so that the industrial computer obtains a current disc gap accordingly and displays the disc gap on the touch screen;

Step 3, using the industrial computer to generate a control command according to a difference value between the current disc gap and the target disc gap and control the disc gap servo control device to adjust a disc spacing, which specifically comprises the following steps that:

Step 3.1, the industrial computer generates the control command according to the difference value between the current disc gap and the target disc gap, and controls the AC servo motor to rotate accordingly; and Step 3.2, the AC servo motor is decelerated by the decelerator, drives the mechanical linkage, and further drives the rotating shaft and the rotating disc to move horizontally for a certain distance, so as to realize precise control of the disc spacing;

Step 4, repeating the steps 2-3 until the current disc gap reaches the target disc gap, then going to the next step; and Step 5, controlling a rotating speed of the driving motor by the industrial computer through a frequency converter according to a target rotating disc rotating speed, and further controlling the rotating disc rotating speed, so that an actual rotating disc rotating speed can reach the target rotating disc rotating speed.

The disc gap servo control device and method have the beneficial effects that:

The present invention relates to a disc gap control of a mill in food processing industry, which can also be applied to the disc gap control of a pulping system in paper making industry, particularly to a disc gap servo control device and method for a disc powder grinding system in the food processing industry.

In the present invention, a three-phase asynchronous motor is used and is fixedly connected with a rotating disc of the disc powder grinding system through a rotating shaft 3, and a frequency converter is used for adjusting the rotating speed of the rotating disc to provide power for a disc powder grinding machine; an AC servo motor is used and is connected with the rotating disc through a mechanical linkage, wherein a position sensor is mounted on the mechanical linkage, and the disc gap is adjusted by the horizontal displacement of the rotating disc, so that the high-precision control of the disc gap is realized; and the operation parameters, such as the rotating speed and the disc gap, of the rotating disc are observed by an industrial computer in real time, and finally the high-precision servo control of the disc gap is realized. The disc gap servo control device and method have an important guiding significance for the actual production operation of the disc powder grinding system.

The present invention is reasonable in design and easy to realize, and has a good utility value.

Figure 1:
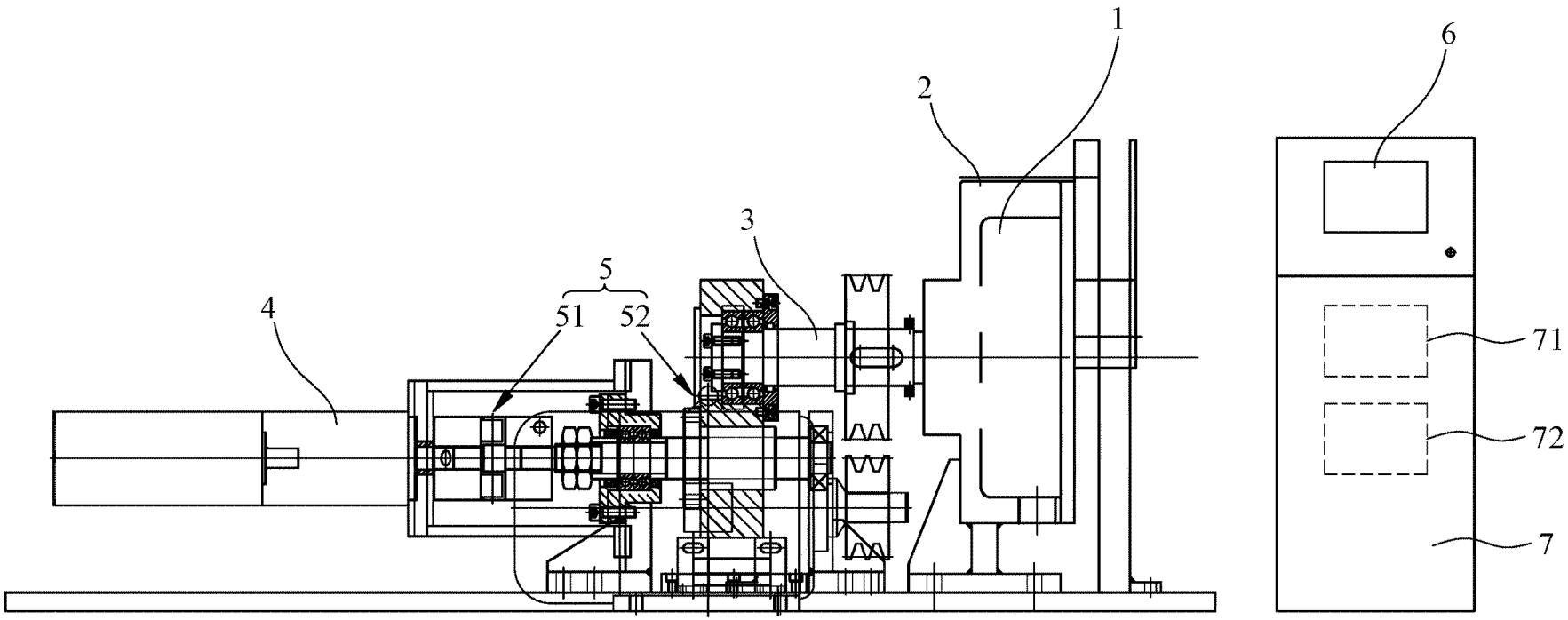
FIG. 1 is a schematically structural diagram of a disc gap servo control device for a disc powder grinding system according to an embodiment of the present invention.

In the drawings: 1 indicates grinding chamber; 2 indicates disc powder grinding machine; 3 indicates rotating shaft; 4 indicates AC servo motor; 5 indicates transmission device; 6 indicates touch screen; 7 indicates control cabinet; 8 indicates feed opening; 9 indicates discharge opening; and 10 indicates driving motor.

DETAILED DESCRIPTION OF THE PREFERRED EMBODIMENT

To make the objectives, technical scheme and advantages of the present invention more clearly, the present invention is described in details below with reference to the accompanying drawings and embodiments. The specific embodiments described herein are merely illustrative of the present invention without limiting the present invention.

Figure 2:
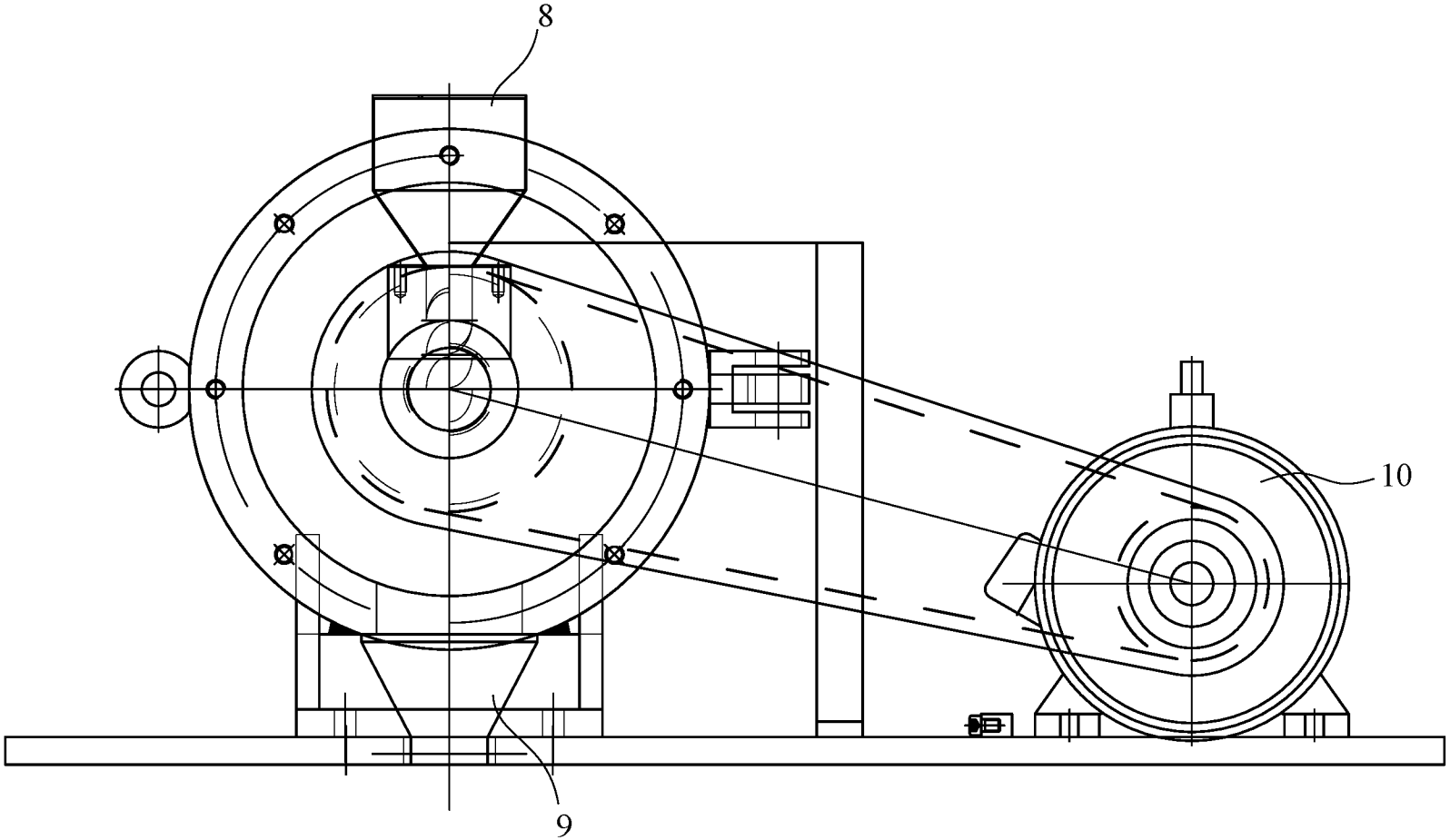
FIG. 2 is a side view of FIG. 1.

The present invention provides a disc gap servo control device for a disc powder grinding system, as shown in FIG. 1 and FIG. 2, the disc powder grinding system comprising: a disc powder grinding machine 2, a rotating speed regulating device of a rotating disc, the disc gap servo control device and the control cabinet 7.

The control cabinet 7 comprises a touch screen 6, an industrial computer 71 and a programmable controller 72.

The touch screen 6 is connected with the industrial computer 71, and a control information is input to the industrial computer 71 through the touch screen 6.

The industrial computer 71 is connected with the programmable controller 72, and a working state of the control device is controlled by the programmable controller 72; the industrial computer 71 is connected with the rotating speed regulating device of the rotating disc and the disc gap servo control device and receives a working state information of the control device, and the working state information is displayed on the touch screen 6.

The programmable controller 72 is connected with and controls the rotating speed regulating device of the rotating disc and the disc gap servo control device.

The programmable controller 72 controls the rotating speed regulating device of the rotating disc and the disc gap servo control device according to a control command of the industrial computer 71.

A feed opening 8 and a discharge opening 9 are disposed in a grinding chamber 1 of the disc powder grinding machine 2, and a rotating disc and a static disc are arranged in the grinding chamber 1, wherein a center of the rotating disc is fixedly connected with a rotating shaft 3; the static disc is fixed inside the grinding chamber 1.

The rotating shaft 3 is connected with the rotating speed regulating device of the rotating disc.

The rotating speed regulating device of the rotating disc comprises a driving motor 10; the rotating speed regulating device of the rotating disc forms a transmission connection with the rotating shaft 3 through a conveyor belt, and drives the rotating disc through the rotating shaft 3 to provide power for the disc powder grinding machine.

The disc gap servo control device comprises an AC servo motor 4, a transmission device 5 and a position sensor.

The transmission device 5 comprises a decelerator 51 and a mechanical linkage 52, wherein the mechanical linkage 52 is connected with the rotating shaft 3.

One end of the decelerator 51 is connected to the AC servo motor 4, and the other end of the decelerator 51 is connected to the mechanical linkage 52; the decelerator 51 is used for converting the power of the AC servo motor 4 into the power that drives the mechanical linkage 52 to move horizontally, so as to control a spacing between the rotating disc and the static disc.

The position sensor is mounted on the mechanical linkage 52 of the disc powder grinding machine 2, a position signal of the rotating disc is collected in real time with a position movement of the mechanical linkage 52, and the position signal is fed back to the control cabinet 7.

The disc powder grinding machine 2 is a double-disc powder grinding machine.

The diameters of the static disc and the rotating disc, the specification of the driving motor 10, and the rotating speed of the rotating disc are determined according to the actual production efficiency and material hardness. In the embodiment, the diameters of the static disc and the rotating disc are 500 mm; and the driving motor 10 is a three-phase asynchronous motor, of which the power is 3 kW and the rotating speed is 0-3000 r/min.

In the embodiment, the power of the AC servo motor 4 is 1 kW.

The rotating speed regulating device of the rotating disc further comprises a frequency converter.

The frequency converter is connected with the driving motor 10 and the programmable controller 72 of the control cabinet 7, wherein the programmable controller 72 controls the frequency converter according to a control command of the industrial computer 71, so as to control the rotating speed of the driving motor.

A disc gap servo control method for a disc powder grinding system, which adopts the disc gap servo control device for the disc powder grinding system, comprises the following steps of:

Step 1, inputting a control information to the industrial computer 71 through the touch screen 6, wherein the control information comprises a target rotating disc rotating speed and a target disc gap;

Step 2, transmitting a position information to the industrial computer 71 through the position sensor, so that the industrial computer 71 obtains a current disc gap accordingly and displays the disc gap on the touch screen 6;

Step 3, using the industrial computer 71 to generate a control command according to a difference value between the current disc gap and the target disc gap and control the disc gap servo control device to adjust a disc spacing, which specifically comprises the following steps that:

Step 3.1, the industrial computer 71 generates the control command according to the difference value between the current disc gap and the target disc gap, and controls the AC servo motor 4 to rotate accordingly; and Step 3.2, the AC servo motor 4 is decelerated by the decelerator 51, drives the mechanical linkage 52, and further drives the rotating shaft 3 and the rotating disc to move horizontally for a certain distance, so as to realize precise control of the disc spacing;

Step 4, repeating the steps 2-3 until the current disc gap reaches the target disc gap, then going to the next step; and Step 5, controlling the rotating speed of the driving motor by the industrial computer 71 through the frequency converter according to the target rotating disc rotating speed, and further controlling the rotating disc rotating speed, so that the actual rotating disc rotating speed can reach the target rotating disc rotating speed.

What is claimed is:

1. A control method for a disc gap servo control device for a disc powder grinding system, the method comprising the following steps:

step 1, inputting a control information to an industrial computer through a touch screen, wherein the control information comprises a target rotating disc rotating speed and a target disc gap;

step 2, transmitting a position information to the industrial computer through a position sensor, so that the industrial computer obtains a current disc gap accordingly and displays the disc gap on the touch screen;

step 3, using the industrial computer to generate a control command according to a difference value between the current disc gap and the target disc gap and control a disc gap servo control device to adjust a disc spacing, which specifically comprises the following steps that:

step 3.1, the industrial computer generates the control command according to the difference value between the current disc gap and the target disc gap, and controls an AC servo motor to rotate accordingly; and step 3.2, the AC servo motor is decelerated by a decelerator, drives a mechanical linkage, and further drives a rotating shaft and a rotating disc to move horizontally for a certain distance, so as to realize precise control of the disc spacing;

step 4, repeating the steps 2-3 until the current disc gap reaches the target disc gap, then going to the next step; and step 5, controlling a rotating speed of a driving motor by the industrial computer through a frequency converter according to a target rotating disc rotating speed, and further controlling the rotating disc rotating speed, so that an actual rotating disc rotating speed can reach the target rotating disc rotating speed.

* * * * *